US009459020B2

(12) United States Patent
Avedon

(10) Patent No.: US 9,459,020 B2
(45) **Date of Patent: *Oct. 4, 2016**

(54) COLUMNAR AIR MOVING DEVICES, SYSTEMS AND METHODS

(75) Inventor: Raymond B. Avedon, Boulder, CO (US)

(73) Assignee: AIRIUS IP HOLDINGS, LLC, Longmont, CO (US)

( * ) Notice: Subject to any disclaimer, the term of this patent is extended or adjusted under 35 U.S.C. 154(b) by 1030 days.

This patent is subject to a terminal disclaimer.

(21) Appl. No.: 13/495,949

(22) Filed: Jun. 13, 2012

(65) Prior Publication Data

US 2013/0023195 A1 Jan. 24, 2013

Related U.S. Application Data

(60) Provisional application No. 61/497,446, filed on Jun. 15, 2011.

(51) Int. Cl.

| | |
|---|---|
| ***F24F 7/00*** | (2006.01) |
| ***F24F 13/06*** | (2006.01) |
| ***F24F 13/065*** | (2006.01) |

(52) U.S. Cl.

CPC ..... *F24F 13/06* (2013.01); *F24F 13/065* (2013.01); *F24F 2013/0612* (2013.01); *F24F 2013/0616* (2013.01); *F24F 2221/14* (2013.01)

(58) Field of Classification Search

CPC ..... F24F 13/06; F24F 13/065; F24F 2003/0612; F24F 2221/14

USPC ..... 454/248

See application file for complete search history.

(56) References Cited

U.S. PATENT DOCUMENTS

| | | | |
|---|---|---|---|
| 917,206 | A | 4/1909 | Watts |
| 1,858,067 | A | 5/1932 | Warren |
| 1,877,347 | A | 9/1932 | McCurdie |
| 1,926,795 | A | 9/1933 | Sassenberg |
| 2,016,778 | A | 10/1935 | Hall et al. |
| 2,189,008 | A | 2/1940 | Kurth |
| 2,189,502 | A | 2/1940 | Johnston |
| 2,232,573 | A | 2/1941 | Teves |
| 2,258,731 | A | 10/1941 | Blumenthal |

(Continued)

FOREIGN PATENT DOCUMENTS

| | | |
|---|---|---|
| CN | 1426729 | 7/2003 |
| CN | 10 1592328 | 12/2009 |

(Continued)

OTHER PUBLICATIONS

International Search Report for Application No. PCT/US2012/042308 mailed Aug. 24, 2012 in 13 pages.

(Continued)

*Primary Examiner* — Helena Kosanovic

(74) *Attorney, Agent, or Firm* — Knobbe, Martens, Olson & Bear, LLP

(57) ABSTRACT

An air moving system includes an air moving device including a housing member, a rotary fan assembly, and a nozzle, the housing including a plurality of air intake vents. The nozzle is configured to move relative to a longitudinal axis of the air moving device. The air moving system includes a ceiling grid structure. The air moving device is configured to rest within a grid within the ceiling grid structure or within an opening in the ceiling.

18 Claims, 12 Drawing Sheets

(56) References Cited

U.S. PATENT DOCUMENTS 2,359,021 A 9/1944 Campbell et al.
2,366,773 A 1/1945 Eklund et al.
2,371,821 A 3/1945 Havis
D152,397 S 1/1949 Damond
2,513,463 A 7/1950 Eklund et al.
2,524,974 A 10/1950 Hickmott
2,615,620 A 10/1952 Goettl
2,632,375 A 3/1953 Stair et al.
2,658,719 A 11/1953 Johanson
2,830,523 A 4/1958 Vehige
2,982,198 A 5/1961 Mohrman
3,012,494 A 12/1961 Drummond
3,036,509 A 5/1962 Babbitt
3,068,341 A 12/1962 Ortiz et al.
D195,287 S 5/1963 Downing
3,099,949 A 8/1963 Davidson
3,165,294 A 1/1965 Anderson
3,212,425 A 10/1965 Lindner et al.
3,246,699 A 4/1966 Jocz
3,300,123 A 1/1967 Freyholdt et al.
3,320,869 A 5/1967 Schach
3,364,839 A 1/1968 Sweeney et al.
3,382,791 A 5/1968 Henry-Biabaud
3,386,368 A 6/1968 Fielding
3,413,905 A 12/1968 Johnson
3,524,399 A 8/1970 Bohanon
3,584,968 A 6/1971 Keith
3,601,184 A 8/1971 Hauville
3,690,243 A * 9/1972 Lambert ..... F24F 13/072 454/303
3,690,244 A 9/1972 Kallel et al.
3,699,872 A 10/1972 Kruger
3,765,317 A 10/1973 Lowe
3,785,271 A 1/1974 Joy
3,827,342 A 8/1974 Hughes
3,835,759 A 9/1974 Lloyd
3,876,331 A 4/1975 DenHerder et al.
3,927,300 A 12/1975 Wada et al.
3,932,054 A 1/1976 McKelvey
3,934,494 A 1/1976 Butler
3,967,927 A 7/1976 Patterson
3,973,479 A 8/1976 Whiteley
3,988,973 A 11/1976 Honmann
4,006,673 A 2/1977 Meyer et al.
4,152,973 A 5/1979 Peterson
4,185,545 A 1/1980 Rusth et al.
D256,273 S 8/1980 Townsend et al.
4,261,255 A 4/1981 Anderson et al.
4,321,659 A 3/1982 Wheeler
4,344,112 A 8/1982 Brown
4,396,352 A 8/1983 Pearce
4,473,000 A 9/1984 Perkins
4,512,242 A 4/1985 Bohanon, Sr.
4,515,538 A 5/1985 Shih
4,522,255 A 6/1985 Baker
4,524,679 A 6/1985 Lyons
4,546,420 A 10/1985 Wheeler et al.
4,548,548 A 10/1985 Gray, III
4,550,649 A 11/1985 Zambolin
4,630,182 A 12/1986 Moroi et al.
4,662,912 A 5/1987 Perkins
4,678,410 A 7/1987 Kullen
4,681,024 A 7/1987 Ivey
4,715,784 A 12/1987 Mosiewicz
4,716,818 A 1/1988 Brown
4,730,551 A 3/1988 Peludat
4,790,863 A 12/1988 Nobiraki et al.
4,794,851 A 1/1989 Kurrle
4,796,343 A 1/1989 Wing
4,848,669 A 7/1989 George
4,850,265 A 7/1989 Raisanen
4,890,547 A 1/1990 Wagner et al.
4,895,065 A 1/1990 Lamparter
D308,416 S 6/1990 Brumbach
4,930,987 A 6/1990 Stahl
4,971,143 A 11/1990 Hogan
4,973,016 A 11/1990 Hertenstein
5,000,081 A 3/1991 Gilmer
5,021,932 A 6/1991 Ivey
5,033,711 A 7/1991 Gregorich et al.
5,042,366 A 8/1991 Panetski et al.
5,078,574 A 1/1992 Olsen
D325,628 S 4/1992 Cho
5,107,755 A 4/1992 Leban et al.
5,121,675 A 6/1992 Muller et al.
5,127,876 A 7/1992 Howe et al.
5,152,606 A 10/1992 Borraccia et al.
5,156,568 A 10/1992 Ricci
5,191,618 A 3/1993 Hisey
D340,765 S 10/1993 Joss et al.
5,251,461 A 10/1993 Fallows, III et al.
5,328,152 A 7/1994 Castle
5,358,443 A 10/1994 Mitchell et al.
5,399,119 A 3/1995 Birk et al.
5,429,481 A 7/1995 Liu
5,439,352 A 8/1995 Line
5,443,625 A 8/1995 Schaffhausen
5,458,505 A 10/1995 Prager
5,462,484 A 10/1995 Jung et al.
5,511,942 A 4/1996 Meier
5,513,953 A 5/1996 Hansen
5,520,515 A 5/1996 Bailey et al.
5,547,343 A 8/1996 Jané et al.
5,561,952 A 10/1996 Damron
5,569,019 A 10/1996 Katariya et al.
5,584,656 A 12/1996 Rose
5,595,068 A 1/1997 Amr
5,613,833 A 3/1997 Wolfe et al.
5,658,196 A 8/1997 Swaim
5,664,872 A 9/1997 Spearman et al.
5,709,458 A 1/1998 Metz
5,725,356 A 3/1998 Carter
5,791,985 A 8/1998 Schiedegger et al.
5,918,972 A 7/1999 Van Belle
5,934,783 A 8/1999 Yoshikawa
D414,550 S 9/1999 Bloom
5,947,816 A 9/1999 Schiedegger et al.
5,967,891 A 10/1999 Riley et al.
5,997,253 A 12/1999 Fechan
6,004,097 A 12/1999 Wark et al.
6,068,385 A 5/2000 Hsieh
6,095,671 A 8/2000 Hutain
6,109,874 A 8/2000 Steiner
6,145,798 A 11/2000 Janisse et al.
6,149,513 A 11/2000 Lyu
6,155,782 A 12/2000 Hsu
6,168,517 B1 1/2001 Cook
6,176,680 B1 1/2001 Ringblom et al.
6,183,203 B1 2/2001 Grintz
6,192,702 B1 2/2001 Shimogori
6,196,915 B1 3/2001 Schiedegger et al.
6,352,473 B1 3/2002 Clark
6,360,816 B1 3/2002 Wagner
6,361,428 B1 3/2002 Tosconi et al.
6,361,431 B1 3/2002 Kawano
6,364,760 B1 4/2002 Rooney
6,383,072 B2 5/2002 Schiedegger et al.
6,384,494 B1 5/2002 Avidano et al.
6,386,828 B1 5/2002 Davis et al.
6,386,970 B1 5/2002 Vernier, II et al.
6,386,972 B1 5/2002 Schiedegger et al.
6,435,964 B1 8/2002 Chang
6,458,028 B2 10/2002 Snyder
6,458,628 B1 10/2002 Distefano et al.
6,484,524 B1 11/2002 Ulanov
6,551,185 B1 4/2003 Miyake et al.
6,575,011 B1 6/2003 Busby et al.
6,581,974 B1 6/2003 Ragner et al.
6,582,291 B2 6/2003 Clark
6,592,328 B1 7/2003 Cahill
6,595,747 B2 7/2003 Bos
6,626,003 B1 9/2003 Kortüm et al.
6,626,636 B2 9/2003 Bohn
6,648,752 B2 11/2003 Vernier, II et al.

(56) References Cited

U.S. PATENT DOCUMENTS

| | | | |
|---|---|---|---|
| 6,679,433 | B2 | 1/2004 | Gordon et al. |
| 6,682,308 | B1 | 1/2004 | Fei et al. |
| 6,700,266 | B2 | 3/2004 | Winkel et al. |
| 6,767,281 | B2 | 7/2004 | McKee |
| 6,783,578 | B2 | 8/2004 | Tillman, Jr. |
| 6,804,627 | B1 | 10/2004 | Marokhovsky et al. |
| 6,805,627 | B2 | 10/2004 | Marts et al. |
| 6,812,849 | B1 | 11/2004 | Ancel |
| 6,886,270 | B2 | 5/2005 | Gilmer |
| 6,916,240 | B1 | 7/2005 | Morton |
| 6,938,631 | B2 | 9/2005 | Gridley |
| 6,951,081 | B2 | 10/2005 | Bonshor |
| 6,966,830 | B2 | 11/2005 | Hurlstone et al. |
| 6,974,381 | B1 | 12/2005 | Walker et al. |
| D514,688 | S | 2/2006 | Avedon |
| 7,011,578 | B1 | 3/2006 | Core |
| 7,044,849 | B2 | 5/2006 | Dippel |
| 7,048,499 | B2 | 5/2006 | Mathson et al. |
| 7,056,092 | B2 | 6/2006 | Stahl |
| 7,101,064 | B2 | 9/2006 | Ancel |
| 7,152,425 | B2 | 12/2006 | Han et al. |
| 7,166,023 | B2 | 1/2007 | Haigh et al. |
| 7,175,309 | B2 | 2/2007 | Craw et al. |
| 7,185,504 | B2 | 3/2007 | Kasai et al. |
| 7,201,110 | B1 | 4/2007 | Pawlak |
| 7,201,650 | B2 | 4/2007 | Demerath et al. |
| 7,214,035 | B2 | 5/2007 | Bussieres et al. |
| 7,288,023 | B2 | 10/2007 | Leopold |
| 7,320,636 | B2 | 1/2008 | Seliger et al. |
| 7,331,764 | B1 | 2/2008 | Reynolds et al. |
| 7,374,408 | B2 | 5/2008 | Savage et al. |
| 7,381,129 | B2 | 6/2008 | Avedon |
| 7,467,931 | B2 | 12/2008 | O'Toole |
| 7,497,773 | B1 | 3/2009 | Schmidt |
| 7,516,578 | B2 | 4/2009 | Bonshor |
| 7,544,124 | B2 | 6/2009 | Polston |
| 7,549,258 | B2 | 6/2009 | Lajewski |
| 7,566,034 | B2 | 7/2009 | Bonshor |
| 7,607,935 | B2 | 10/2009 | Dahl |
| 7,610,726 | B2 | 11/2009 | Lajewski |
| 7,645,188 | B1 | 1/2010 | Peerbolt |
| 7,651,390 | B1 | 1/2010 | Profeta et al. |
| 7,677,770 | B2 | 3/2010 | Mazzochette |
| 7,677,964 | B1 | 3/2010 | Bucher et al. |
| 7,708,625 | B2 | 5/2010 | Leseman et al. |
| 7,752,814 | B2 | 7/2010 | Bonshor |
| 7,774,999 | B2 | 8/2010 | McKee |
| 7,780,510 | B2 | 8/2010 | Polston |
| D631,148 | S | 1/2011 | Benton et al. |
| 7,901,278 | B2 | 3/2011 | O'Hagin |
| 7,930,858 | B2 | 4/2011 | Lajewski |
| 8,052,386 | B1 | 11/2011 | Fitzpatrick et al. |
| D672,863 | S | 12/2012 | Romero Carreras |
| D681,184 | S | 4/2013 | Romero Carreras |
| 8,596,596 | B2 | 12/2013 | Naji et al. |
| 8,616,842 | B2 | 12/2013 | Avedon |
| D698,916 | S | 2/2014 | Avedon |
| 8,967,983 | B2 | 3/2015 | Kampf |
| 8,992,174 | B2 | 3/2015 | Chang |
| 9,151,295 | B2 | 10/2015 | Avedon |
| D746,971 | S | 1/2016 | Avedon |
| 2001/0049927 | A1 | 12/2001 | Toepel |
| 2002/0045420 | A1 | 4/2002 | Taillon |
| 2002/0137454 | A1 | 9/2002 | Baker |
| 2004/0050077 | A1 | 3/2004 | Kasai et al. |
| 2004/0052641 | A1 | 3/2004 | Chen |
| 2004/0240214 | A1 | 12/2004 | Whitlow et al. |
| 2004/0253095 | A1 | 12/2004 | Sasaki et al. |
| 2005/0092888 | A1 | 5/2005 | Gonce |
| 2005/0159101 | A1 | 7/2005 | Hrdina et al. |
| 2005/0202776 | A1 | 9/2005 | Avedon |
| 2006/0087810 | A1 | 4/2006 | Rockenfeller |
| 2006/0172688 | A1 | 8/2006 | Johnson |
| 2006/0276123 | A1 | 12/2006 | Sanagi et al. |
| 2006/0284435 | A1 | 12/2006 | Vitito |
| 2007/0213003 | A1 | 9/2007 | Railkar et al. |
| 2007/0297906 | A1 | 12/2007 | Wu |
| 2008/0019836 | A1 | 1/2008 | Butz et al. |
| 2008/0188175 | A1 | 8/2008 | Wilkins |
| 2008/0227381 | A1* | 9/2008 | Avedon ..... F04D 25/088 454/230 |
| 2009/0041580 | A1 | 2/2009 | Wichmann et al. |
| 2009/0155080 | A1 | 6/2009 | Yu |
| 2009/0170421 | A1 | 7/2009 | Adrian et al. |
| 2009/0219727 | A1 | 9/2009 | Weaver |
| 2009/0262550 | A1 | 10/2009 | Inoue |
| 2010/0009621 | A1 | 1/2010 | Hsieh |
| 2010/0052495 | A1 | 3/2010 | Liu et al. |
| 2010/0176706 | A1 | 7/2010 | Fu et al. |
| 2010/0192611 | A1 | 8/2010 | Yamaguchi et al. |
| 2010/0202932 | A1 | 8/2010 | Danville |
| 2010/0266400 | A1 | 10/2010 | Avedon |
| 2011/0037368 | A1 | 2/2011 | Huang |
| 2011/0057551 | A1 | 3/2011 | Lee et al. |
| 2011/0057552 | A1 | 3/2011 | Weaver |
| 2011/0080096 | A1 | 4/2011 | Dudik et al. |
| 2011/0084586 | A1 | 4/2011 | Lain et al. |
| 2011/0133622 | A1 | 6/2011 | Mo et al. |
| 2011/0140588 | A1 | 6/2011 | Chen |
| 2012/0195749 | A1 | 8/2012 | Avedon |
| 2013/0027950 | A1 | 1/2013 | Avedon |
| 2013/0196588 | A1 | 8/2013 | Liao |
| 2014/0314560 | A1 | 10/2014 | Avedon |
| 2015/0176834 | A1 | 6/2015 | Avedon |
| 2015/0176851 | A1 | 6/2015 | Avedon |
| 2015/0354578 | A1 | 12/2015 | Avedon |

FOREIGN PATENT DOCUMENTS

| | | |
|---|---|---|
| CN | 201 560 963 | 8/2010 |
| DE | 44 13 542 | 10/1995 |
| DE | 196 38 518 | 4/1998 |
| DE | 10 2008 044874 | 3/2010 |
| EP | 0 037 958 | 10/1981 |
| EP | 0 212 749 | 3/1987 |
| EP | 0 772 007 | 5/1997 |
| EP | 2 248 692 | 11/2010 |
| FR | 0 715 101 | 11/1931 |
| FR | 2 784 423 | 4/2000 |
| GB | 0 824 390 | 11/1959 |
| GB | 0 981 188 | 1/1965 |
| GB | 2 344 619 | 6/2000 |
| GB | 2 468 504 | 9/2010 |
| JP | 55-032965 | 3/1980 |
| JP | 61-502267 | 10/1986 |
| JP | 07-167097 | 7/1995 |
| JP | 07-253231 | 10/1995 |
| JP | 08-219939 | 8/1996 |
| JP | 11-132543 | 5/1999 |
| JP | 2001-193979 | 7/2001 |
| JP | 2002-349489 | 12/2002 |
| JP | 2006-350237 | 12/2006 |
| JP | 2010-181124 | 8/2010 |
| KR | 20-0176664 | 4/2000 |
| KR | 2003-0025428 | 3/2003 |
| KR | 10-1255739 | 4/2013 |
| RU | 2400254 C2 | 9/2010 |
| TW | M337636 | 8/2008 |
| WO | WO 01/34983 | 5/2001 |
| WO | WO 2005/091896 | 10/2005 |
| WO | WO 2006/078102 | 7/2006 |
| WO | WO 2008/062319 | 5/2008 |
| WO | WO 2010/046536 A1 | 4/2010 |
| WO | WO 2010/114702 | 10/2010 |
| WO | WO 2011/067430 | 6/2011 |
| WO | WO 2012/174155 | 12/2012 |
| WO | WO 2012/174156 | 12/2012 |
| WO | WO 2015/187856 | 12/2015 |

OTHER PUBLICATIONS

Official Communication in Australian Application No. 2005227197, dated Nov. 23, 2009, in 3 pages.

(56) References Cited

OTHER PUBLICATIONS

Official Communication in Australian Application No. 2005227197, dated Dec. 20, 2010, in 2 pages.
Official Communication in Australian Application No. 2005227197, dated Mar. 30, 2011 in 2 pages.
Official Communication in Australian Application No. 2011253799, dated Sep. 17, 2012, in 4 pages.
Official Communication in Canadian Application No. 2,559,610, dated Aug. 26, 2011 in 3 pages.
European Search Report for Application No. EP 05714125.1, dated May 4, 2009 in 5 pages.
Official Communication in European Application No. 05714125.1, dated Mar. 11, 2010, in 7 pages.
Official Communication in European Application No. 05714125.1, dated Jul. 4, 2012, in 5 pages.
European Search Report for Application No. EP 12160654.5, dated Aug. 24, 2012 in 6 pages.
Official Communication in Japanese Application No. 2007-503918, dated Oct. 26, 2010 in 3 pages.
Official Communication in Japanese Application No. 2007-503918, dated May 18, 2011 in 2 pages.
Official Communication in Korean Application No. 10-2006-7021292, dated Mar. 16, 2012, in 12 pages.
Official Communication in New Zealand Application No. 549851, dated Mar. 10, 2009, in 3 pages.
Official Communication in New Zealand Application No. 549851, dated Sep. 22, 2010, in 2 pages.
Official Communication in Polish Application No. P-382705, dated Nov. 10, 2011, in 1 page.
International Search Report and Written Opinion in International Application No. PCT/US2010/027546, dated May 12, 2010 in 7 pages.
International Search Report and Written Opinion in International Application No. PCT/US2012/042309, dated Oct. 24, 2012 in 12 pages.

* cited by examiner

COLUMNAR AIR MOVING DEVICES, SYSTEMS AND METHODS

CROSS-REFERENCE TO RELATED APPLICATIONS

This application claims benefit under 35 U.S.C. §119(e) to U.S. Provisional Patent Application No. 61/497,446, filed Jun. 15, 2011, which is incorporated in its entirety by reference herein.

This application is related to U.S. Provisional Patent Application No. 61/497,422, entitled Columnar Air Moving Devices, Systems and Methods, filed Jun. 15, 2011, and to U.S. Provisional Patent Application No. 61/497,448, entitled Columnar Air Moving Devices, Systems and Methods, filed Jun. 15, 2011, each of which is incorporated in its entirety by reference herein. This application is also related to U.S. patent Ser. No. 12/130,909, filed May 30, 2008, and to U.S. patent application Ser. No. 12/724,799, filed Mar. 16, 2010, each of which is incorporated in its entirety by reference herein.

BACKGROUND OF THE INVENTIONS

1. Field of the Inventions

The present application relates generally to systems, devices and methods for moving air that are particularly suitable for creating air temperature de-stratification within a room, building, or other structure.

2. Description of the Related Art

The rise of warm air and the sinking of cold air can create significant variation in air temperatures between the ceiling and floor of buildings with conventional heating, ventilation and air conditioning systems. Air temperature stratification is particularly problematic in any spaces with any ceilings such as warehouses, gymnasiums, offices, auditoriums, hangers, commercial buildings, offices, residences with cathedral ceilings, agricultural buildings, and other structures, and can significantly increase heating and air conditioning costs. Structures with both low and high ceiling rooms can often have stagnant or dead air, as well, which can further lead to air temperature stratification problems.

One proposed solution to air temperature stratification is a ceiling fan. Ceiling fans are relatively large rotary fans, with a plurality of blades, mounted near the ceiling. The blades of a ceiling fan have a flat or airfoil shape. The blades have a lift component that pushes air upwards or downwards, depending on the direction of rotation, and a drag component that pushes the air tangentially. The drag component causes tangential or centrifugal flow so that the air being pushed diverges or spreads out. Conventional ceiling fans are generally ineffective as an air de-stratification device in relatively high ceiling rooms because the air pushed by conventional ceiling fans is not maintained in a columnar pattern from the ceiling to the floor, and often disperses or diffuses well above the floor.

Another proposed solution to air temperature stratification is a fan connected to a vertical tube that extends substantially from the ceiling to the floor. The fan can be mounted near the ceiling, near the floor or in between. This type of device can push cooler air up from the floor to the ceiling or warmer air down from the ceiling to the floor. Such devices, when located away from the walls in an open space in a building, interfere with floor space use and are not aesthetically pleasing. When confined to locations only along the walls of an open space, such devices may not effectively circulate air near the center of the open space. Examples of fans connected to vertical tubes are disclosed in U.S. Pat. No. 3,827,342 to Hughes, and U.S. Pat. No. 3,973,479 to Whiteley.

A more practical solution is a device, for example, with a rotary fan that minimizes a rotary component of an air flow while maximizing axial air flow quantity and velocity, thereby providing a column of air that flows from a high ceiling to a floor in a columnar pattern with minimal lateral dispersion without a physical transporting tube. Examples of this type of device are described in U.S. patent application Ser. No. 12/130,909, filed May 30, 2008, and U.S. patent application Ser. No. 12/724,799, filed Mar. 16, 2010, each of which is incorporated in its entirety by reference herein.

SUMMARY OF THE INVENTION

An aspect of at least one of the embodiments disclosed herein includes the realization that it would be beneficial to have a columnar air moving device that has a low vertical profile, such that the device can fit into the ceiling structure of a building without extending below the ceiling to an extent that it is distracting or obstructive, and can fit within two generally horizontal ceiling structures.

Another aspect of at least one of the embodiments disclosed herein includes the realization that it would be beneficial to have a columnar air moving device that is designed specifically to fit within a ceiling grid structure, such that it is easy to install, remove, and replace the columnar air moving device if required.

Another aspect of at least one of the embodiments disclosed herein includes the realization that rooms within a building often have support beams or other structures that can make it difficult to install a columnar air moving device (or devices) within the room and direct the air to a predefined area. It would be advantageous to have a columnar air moving device that is configured to have a nozzle or other structure that can be rotated or moved, so as to direct the column of air towards a desired area generally away from an area directly below the columnar air moving device.

Thus, in accordance with at least one embodiment described herein, an air moving system can comprise a ceiling structure comprising a first ceiling level forming a base portion of the ceiling, the first ceiling level having a plurality of grid cells, each grid cell bordered by a grid cell periphery structure, the ceiling structure further comprising a second ceiling level separated from the first ceiling level by a first height, an air moving device positioned at least partially within one of the grid cells in the first ceiling level, the air moving device comprising a housing member forming an interior space within the air moving device, the housing member having a top surface, the housing member being positioned within the ceiling structure such that the top surface is located between the first and second ceiling levels, a lip member forming an outer peripheral edge of air moving device, at least part of the lip member supported by the grid cell periphery structure, the housing member comprising a plurality of air vents for directing a volume of air into the interior space of the air moving device, a rotary fan assembly mounted in the interior space, the rotary fan assembly comprising an impeller and a plurality of blades, the rotary fan assembly configured to direct the volume of air within the interior space, and a nozzle communicating with and extending downwardly from the rotary fan assembly, the nozzle comprising a structure for further directing the volume of air out of the air moving device.

In accordance with at least another embodiment, an air moving device can comprise a housing member forming an interior space within the air moving device, the housing member comprising a plurality of air vents for directing a volume of air into the interior space of the air moving device, a rotary fan assembly mounted in the interior space, the rotary fan assembly comprising an impeller and a plurality of blades, the rotary fan assembly configured to direct the volume of air within the interior space, and a nozzle communicating with and extending downwardly from the rotary fan assembly, the nozzle comprising a structure for further directing the volume of air out of the air moving device, wherein the air moving device comprises a longitudinal axis, the housing member comprises an opening for insertion of the nozzle, and the nozzle comprises at least one spherical surface configured to fit within the opening such that the nozzle can be adjusted preferably at various angles relative to the longitudinal axis.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENTS

Figure 1:
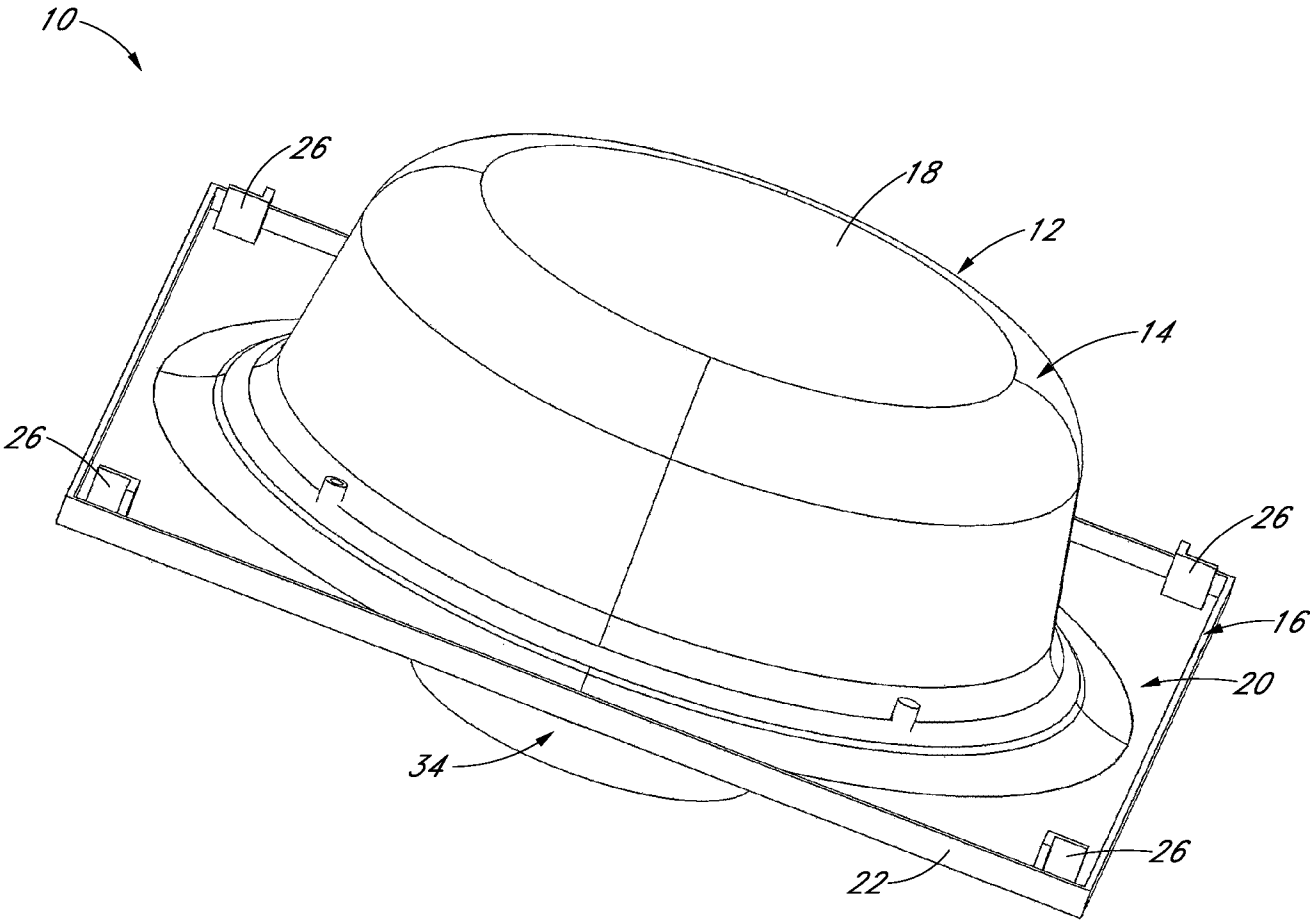
FIG. 1 is a top perspective view of an air moving device in accordance with an embodiment.
Figure 2:
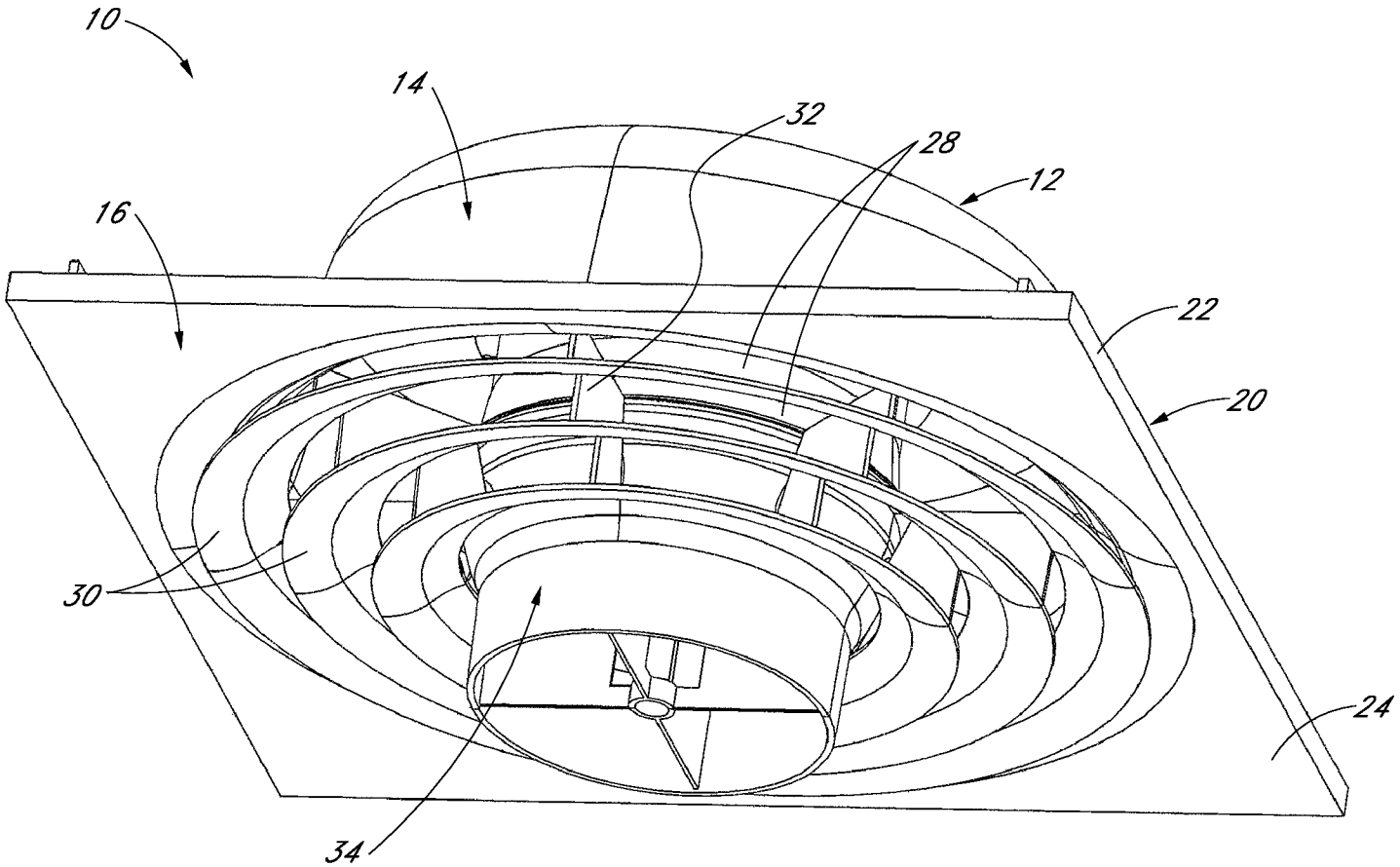
FIG. 2 is a bottom perspective view of the air moving device of FIG. 1.

With reference to FIGS. 1-5, an air moving device 10 can comprise a housing member 12. The housing member 12 can form an outer shell of the air moving device 10, and can at least partially enclose an interior space within the air moving device 10. The housing member 12 can be formed from one or more sections. For example, the housing member 12 can comprise an upper housing section 14, and a lower housing section 16. In some embodiments the upper and lower housing sections 14, 16 can be attached to one another through use of fasteners, adhesive, or other structure. In some embodiments the upper housing section 14 can comprise a dome shape. In some embodiments, the upper housing section 14 can comprise a generally round, circumferentially-shaped structure, and the lower housing section 16 can comprise a generally rectangular-shaped structure. In some embodiments the lower housing section 16 can form an outer periphery of the housing member 12. In some embodiments, the dome shaped upper housing section 14 and rectangular-shaped lower housing section 16 can be integrally formed as a single piece.

Figure 10:
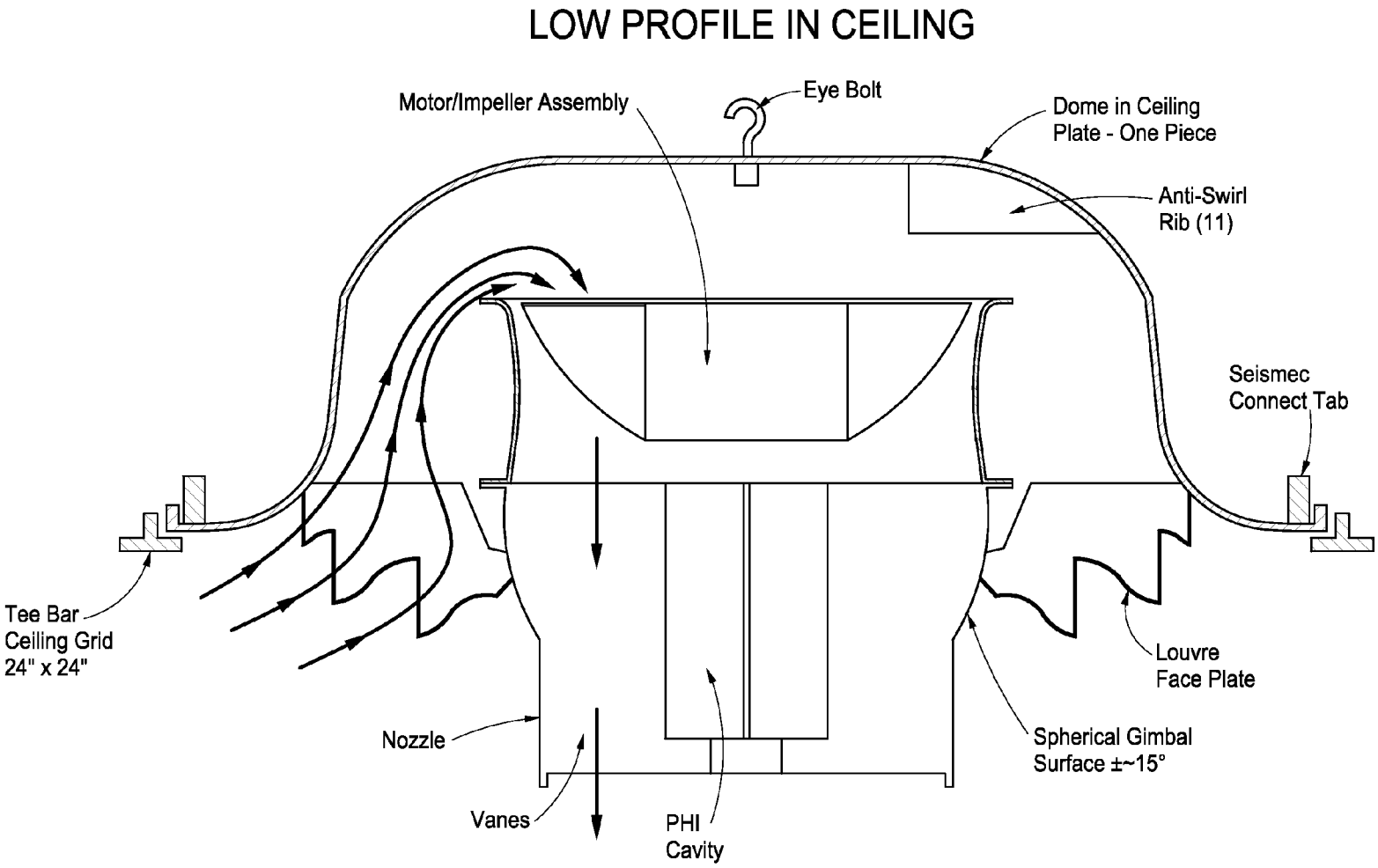
FIG. 10 is a schematic, cross-sectional view of an air moving device in accordance with an embodiment.

The housing member 12 can include a top surface 18. In some embodiments the top surface 18 can include or be attached to a support member. The support member can include, for example, a ring-shaped structure (e.g. an eye-bolt as illustrated in FIG. 10). In some embodiments, the housing member 12 can be hung by the support member, and/or can be attached to another structure with the support member. In some embodiments, and as described further below, the top surface 18, and/or any support member formed from or attached to top surface 18, can be configured to rest between two generally horizontal ceiling structures within an air moving system.

With reference to FIGS. 1-5, the housing member 12 can comprise a ceiling support structure 20. The ceiling support structure 20 can form part of the lower housing section 16. The ceiling support structure 20 can be a separate component attached to the housing member 12. In some embodiments, the ceiling support structure 20 can comprise a lip member. The ceiling support structure 20 can include an outer peripheral edge 22. The outer peripheral edge 22 of the ceiling support structure 20 can form a generally rectangular structure around the air moving device 10, though other shapes are also possible. The outer peripheral edge 22 can form an outer peripheral edge of the air moving device 10. The ceiling support structure 20 can also include a lower surface 24. At least a portion of the lower surface 24 can be configured to rest upon one or more ceiling structures when the air moving device 10 is mounted in a ceiling. The lower surface 24 can be a generally flat surface, though other surfaces are also possible.

With continued reference to FIGS. 1-5, the ceiling support structure 20 can include one or more seismic connect tabs 26. The seismic connect tabs 26 can be used to connect the air moving device 10 to one or more ceiling structures in a ceiling. The seismic connect tabs 26 can permit movement of the air moving device 10 relative to one or more ceiling structures during the event of an earthquake or other similar event.

With continued reference to FIGS. 1-5 and 9, the housing member 12 can comprise at least one air vent 28. The air vent or vents 28 can be configured to direct a volume of air into the interior space of the air moving device 10. For example, the housing member 12 can comprise a plurality of air vents 28 in the lower housing section 16. The plurality of air vents 28 can be spaced directly below the ceiling support structure 20. In some embodiments the air vents 28 can be separated by air vent guides 30. The air vent guides 30 can comprise ring-like structures extending generally circumferentially along the lower housing section 16. In some embodiments the outer diameters of the air vent guides 30 can decrease moving downwardly away from the ceiling support structure 20.

The air vent guides 30 can be connected to air vent face plates 32. The air vent face plates 32 can be spaced circumferentially around the lower housing section 16. The air vent face plates 32, in conjunction with the air vent guides 30, can be configured to direct a volume of air inwardly through the air vents 28, and up into the interior space defined by the housing member 12. The air vent face plates 32 can be solid structures that divide the air vents 28 into sections or portions.

With continued reference to FIGS. 1-4, the air moving device 10 can comprise a nozzle 34. The nozzle 34 can communicate with and extend downwardly from the housing member 12. The nozzle 34 can comprise a structure for directing a volume of air out of the air moving device 10. For example, the nozzle 34 can comprise a structure for directing a volume of air out of the air moving device 10 that has previously entered through the plurality of air vents 28. In some embodiments, the nozzle 34 is attached to the housing member 12.

Figure 6:
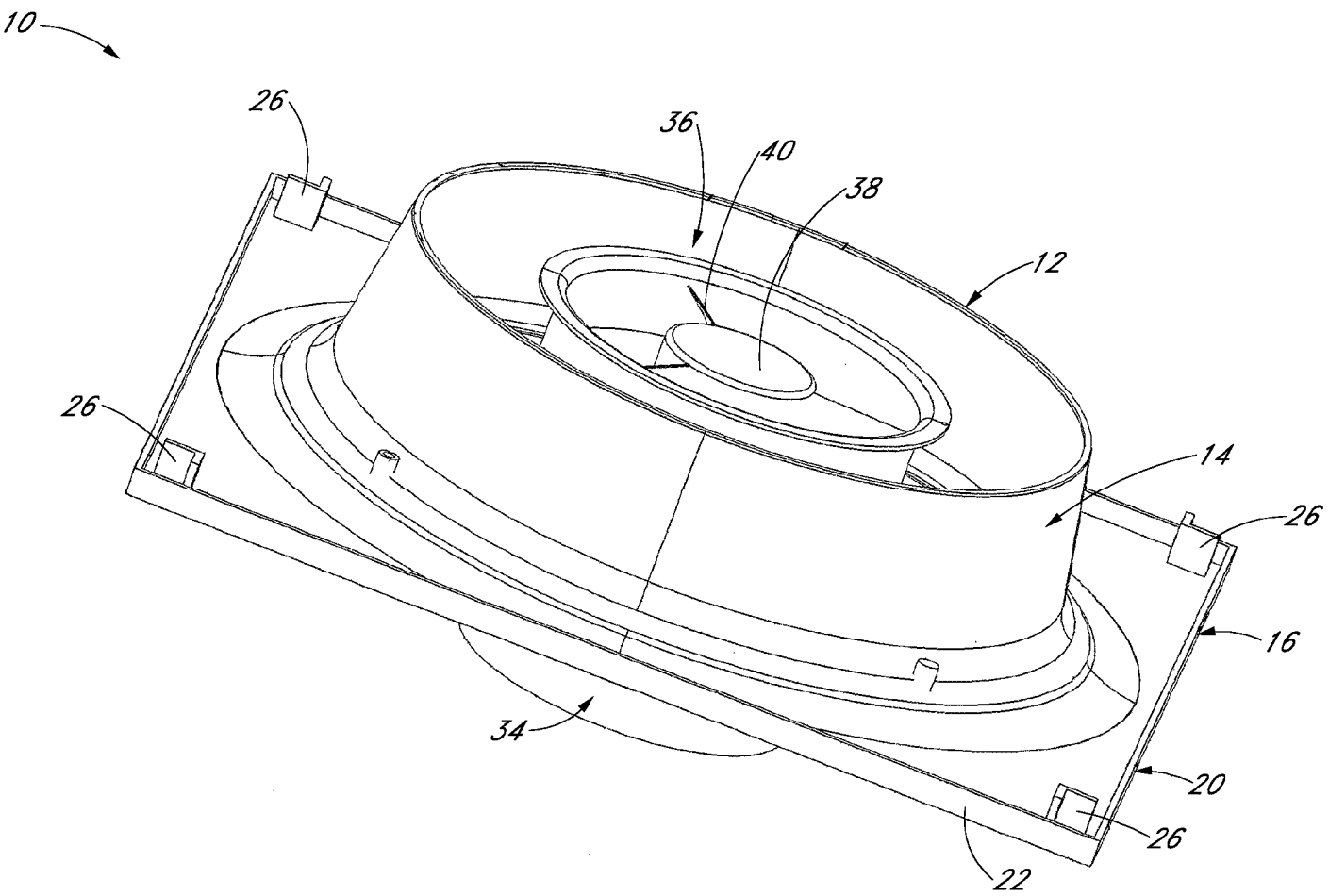
FIG. 6 is a perspective, partial view of the device of FIG. 1, taken along line 6-6 in FIG. 3.
Figure 9:
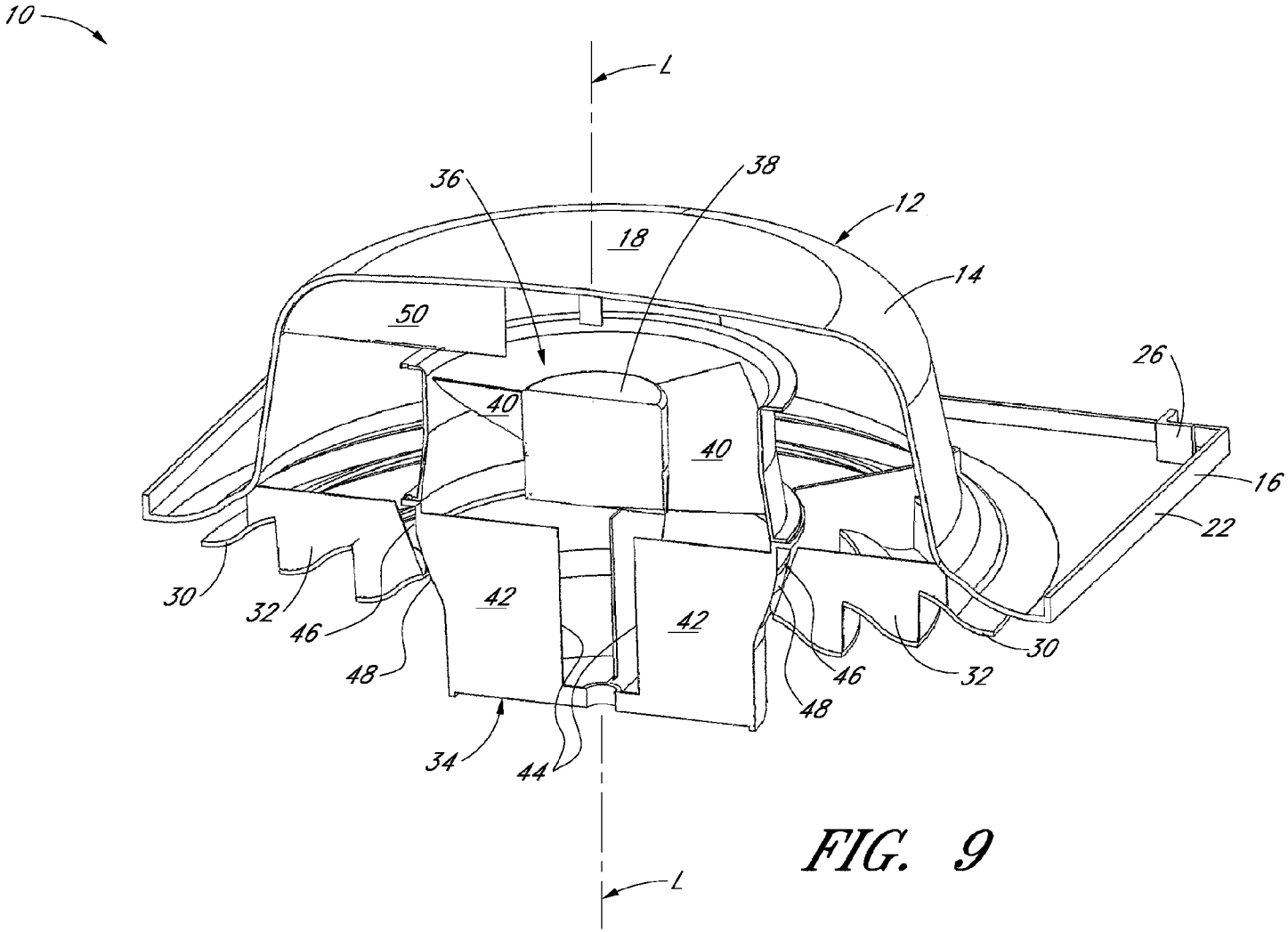
FIG. 9 is cross-sectional view of the device of FIG. 1, taken along line 9-9 in FIG. 3.

With reference to FIGS. 6 and 9, the air moving device 10 can comprise a rotary fan assembly 36 mounted within the interior space. The rotary fan assembly 36 can comprise an impeller 38 and a plurality of blades 40. The rotary fan assembly 36 can be configured to direct a volume of air that has entered through the plurality of air vents 28 downwardly into the nozzle 34. The rotary fan assembly 36 can push, or force, a volume of air downwardly within the interior space of the air moving device 10. The rotary fan assembly 36 can comprise a motor. The rotary fan assembly 36 can comprise at least one electrical component. The rotary fan assembly 36 can be mounted generally above the plurality of air vents 28, such that the volume of air entering the plurality of air vents 28 is required to travel upwardly within the interior space of the air moving device 10 before it can enter the rotary fan assembly 36. In some embodiments, the rotary fan assembly 36 can be mounted to the lower housing section 16. The nozzle 34 can communicate with and extend downwardly from the rotary fan assembly 36. In some embodiments, the nozzle 34 is attached to the rotary fan assembly 36.

Figure 7:
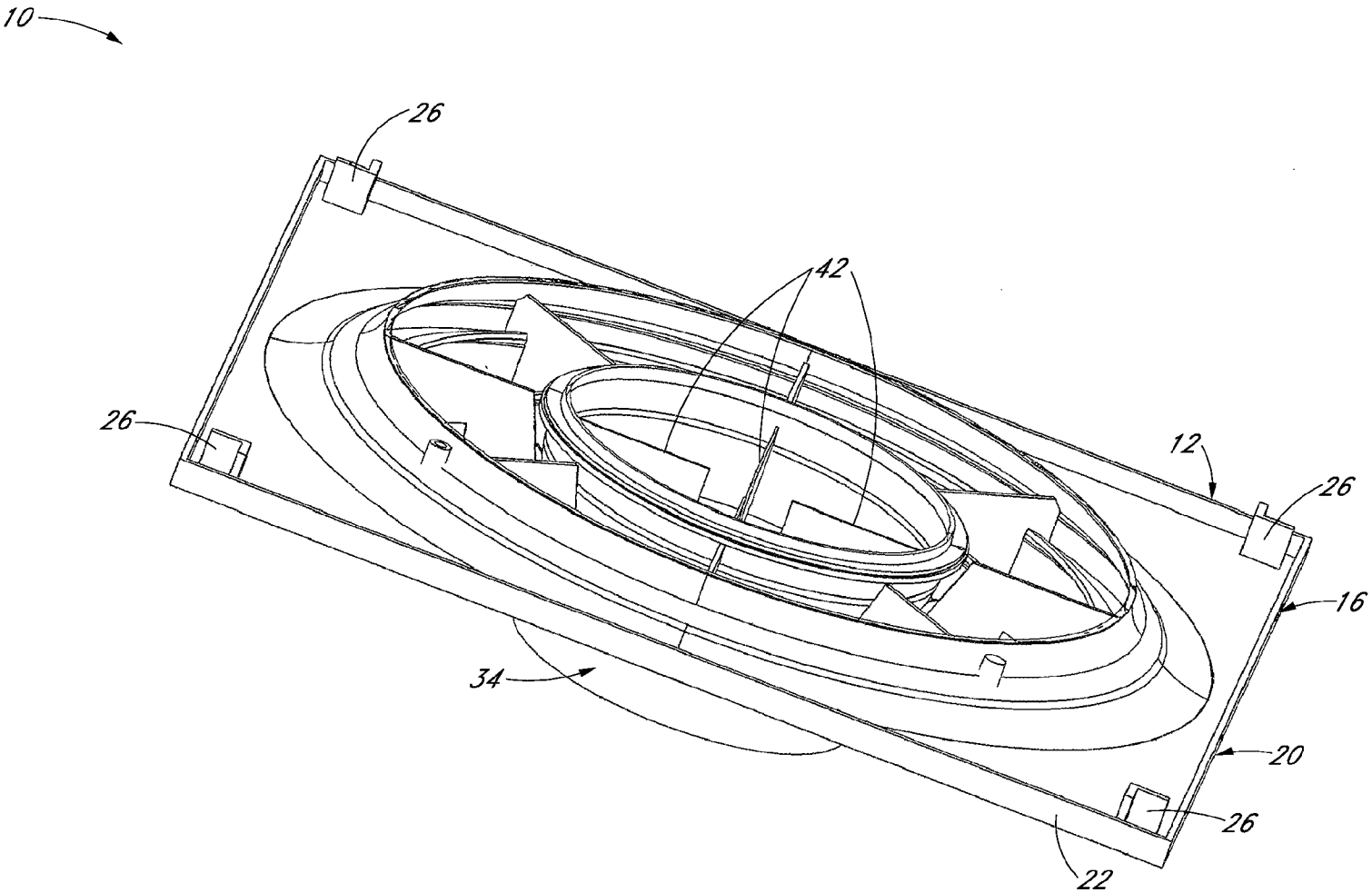
FIG. 7 is a perspective, partial view of the device of FIG. 1, taken along line 7-7 in FIG. 3.
Figure 8:
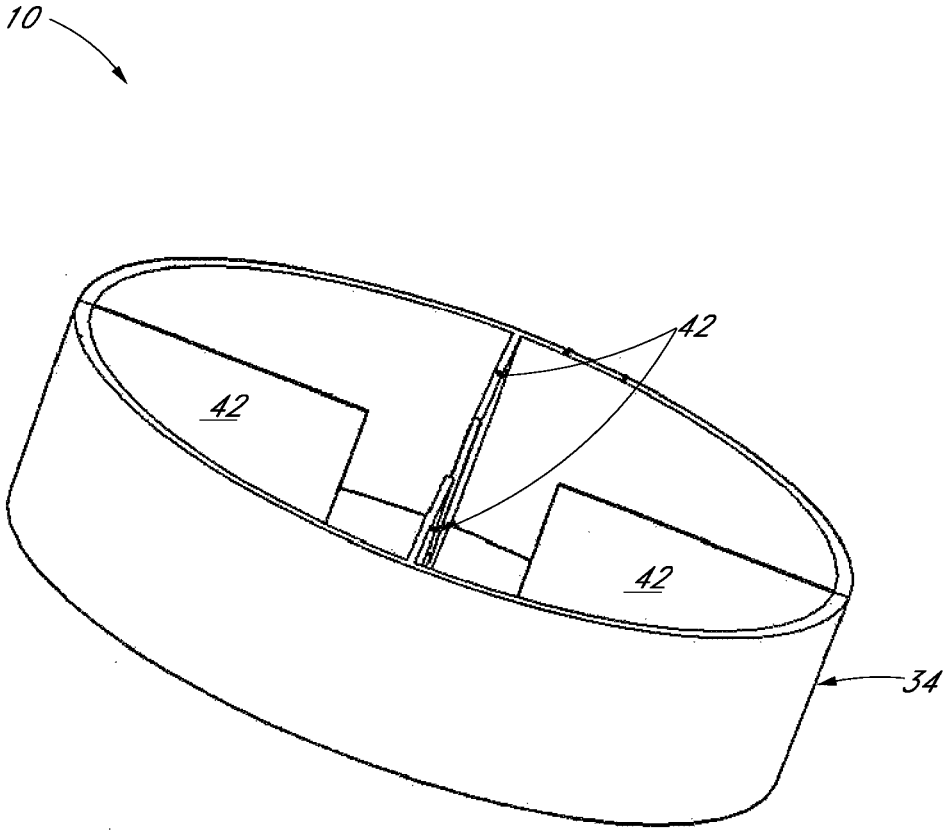
FIG. 8 a perspective, partial view of the device of FIG. 1, taken along line 8-8 in FIG. 3.

With continued reference to FIGS. 7-9, the air moving device 10 can include additional structures that facilitate de-stratification. For example, the nozzle 34 of the air moving device 10 can comprise at least one stator vane 42. The stator vanes 42 can be positioned equidistantly in a circumferential pattern within the nozzle 34. The stator vanes 46 can further direct the volume of air that has entered through the plurality of air vents 28 and has moved into the rotary fan assembly 36 and further down into the nozzle 34. For example, the stator vanes 42 can be used to straighten a volume of air within the nozzle 34. The stator vanes 42 can be used to force a volume of air to move in a generally columnar direction downwardly towards the floor of a building or other structure, with minimal lateral dispersion, similar to the devices described for example in U.S. patent Ser. No. 12/130,909, and U.S. patent application Ser. No. 12/724,799, each of which is incorporated in its entirety by reference herein. In some embodiments, the nozzle 34 can have no stator vanes 42.

With reference to FIG. 9, in some embodiments the stator vanes 42 can comprise one or more cutouts 44. The cutouts 44 can create space for insertion, for example, of an ionization cell (i.e. a PHI cell). The ionization cell can be used to increase the air quality. The cutouts 44 can form a void or opening in the middle of the nozzle 34, and the ionization cell (not shown) can be inserted into the opening for example during manufacturing. The volume of air moving through the air moving device 10 can run past, alongside, or through the ionization cell, and be cleaned.

Figure 3:
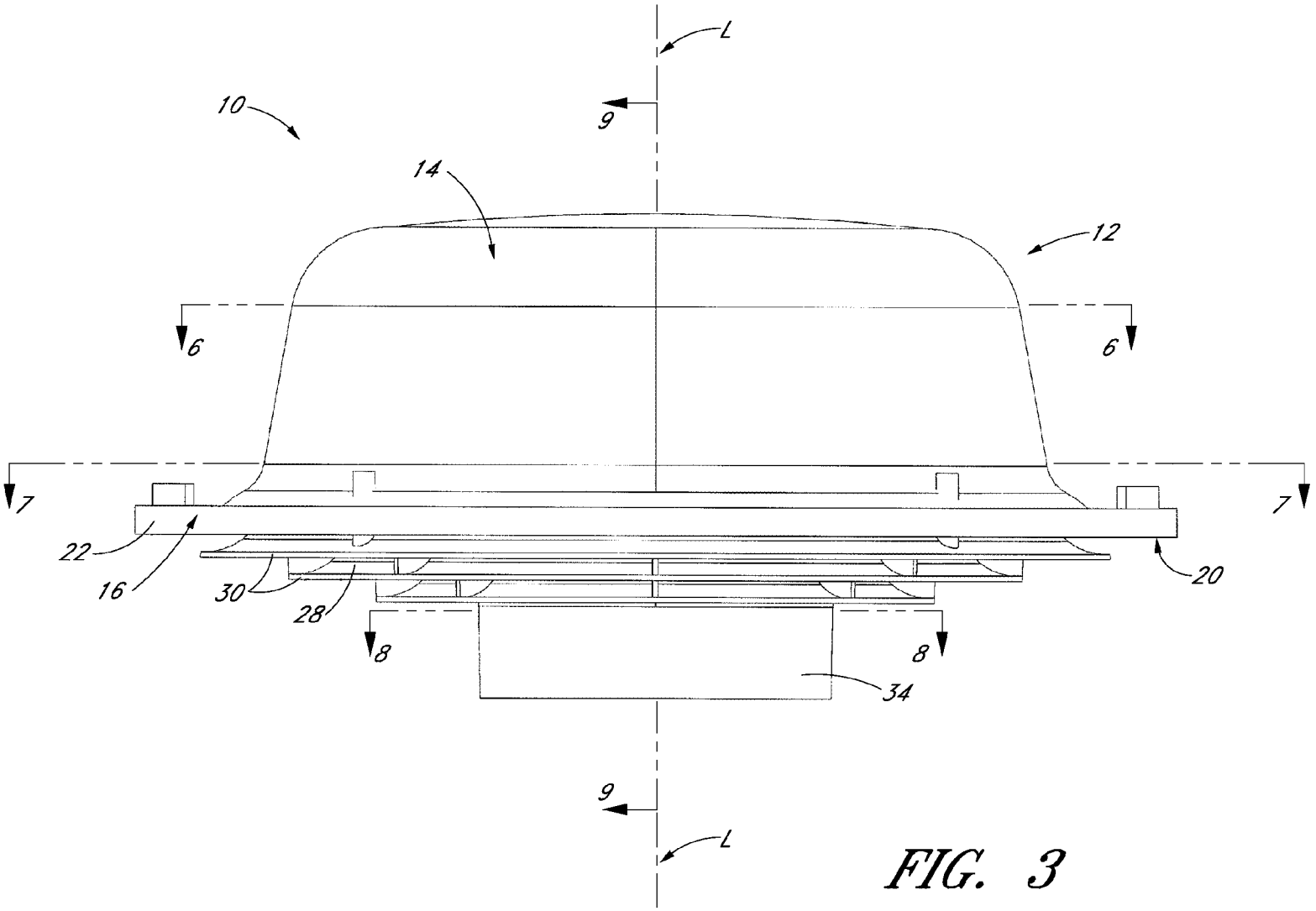
FIG. 3 is a front elevation view of the device of FIG. 1.
Figure 4:
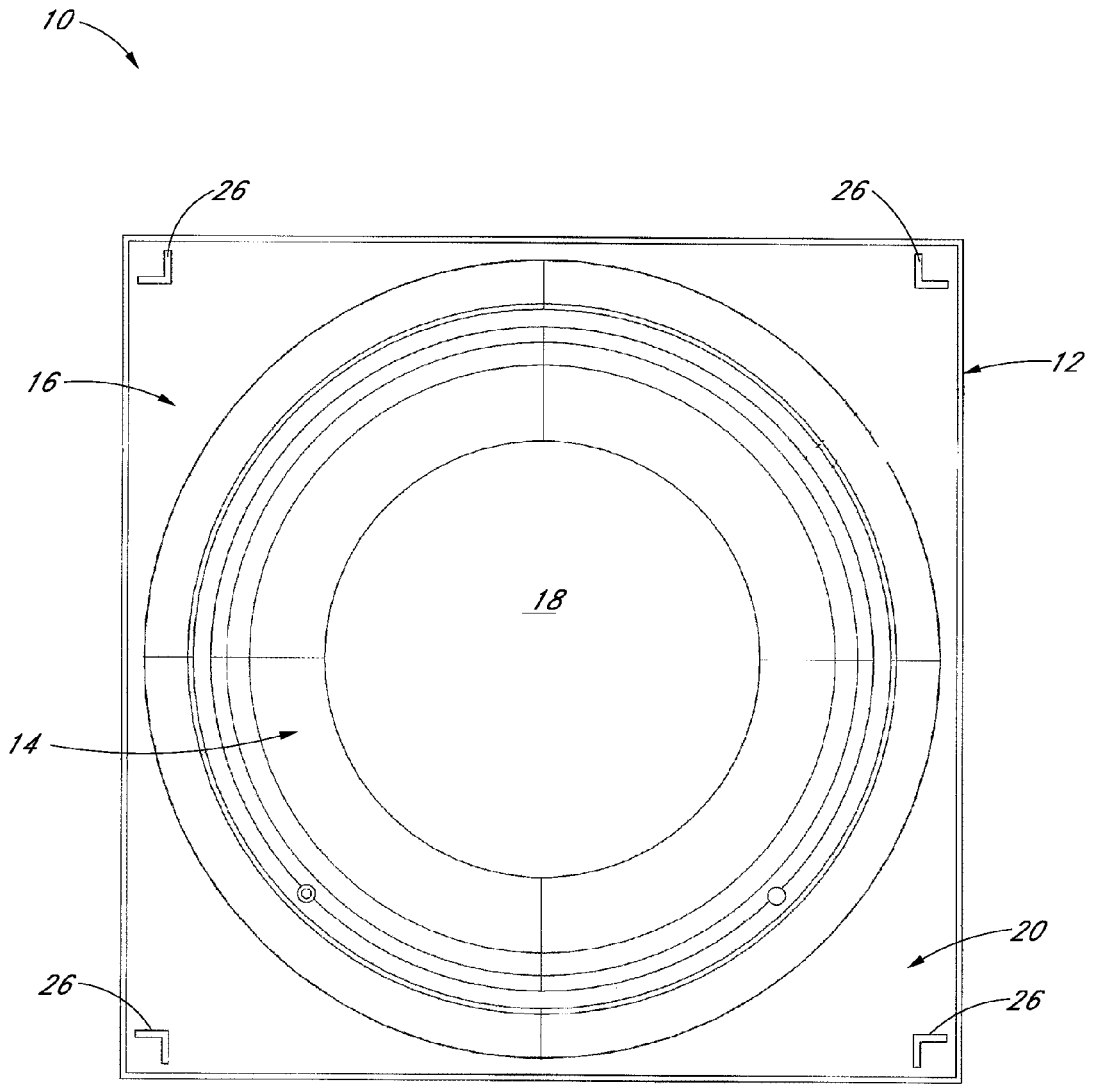
FIG. 4 is a top plan view of the device of FIG. 1.
Figure 5:
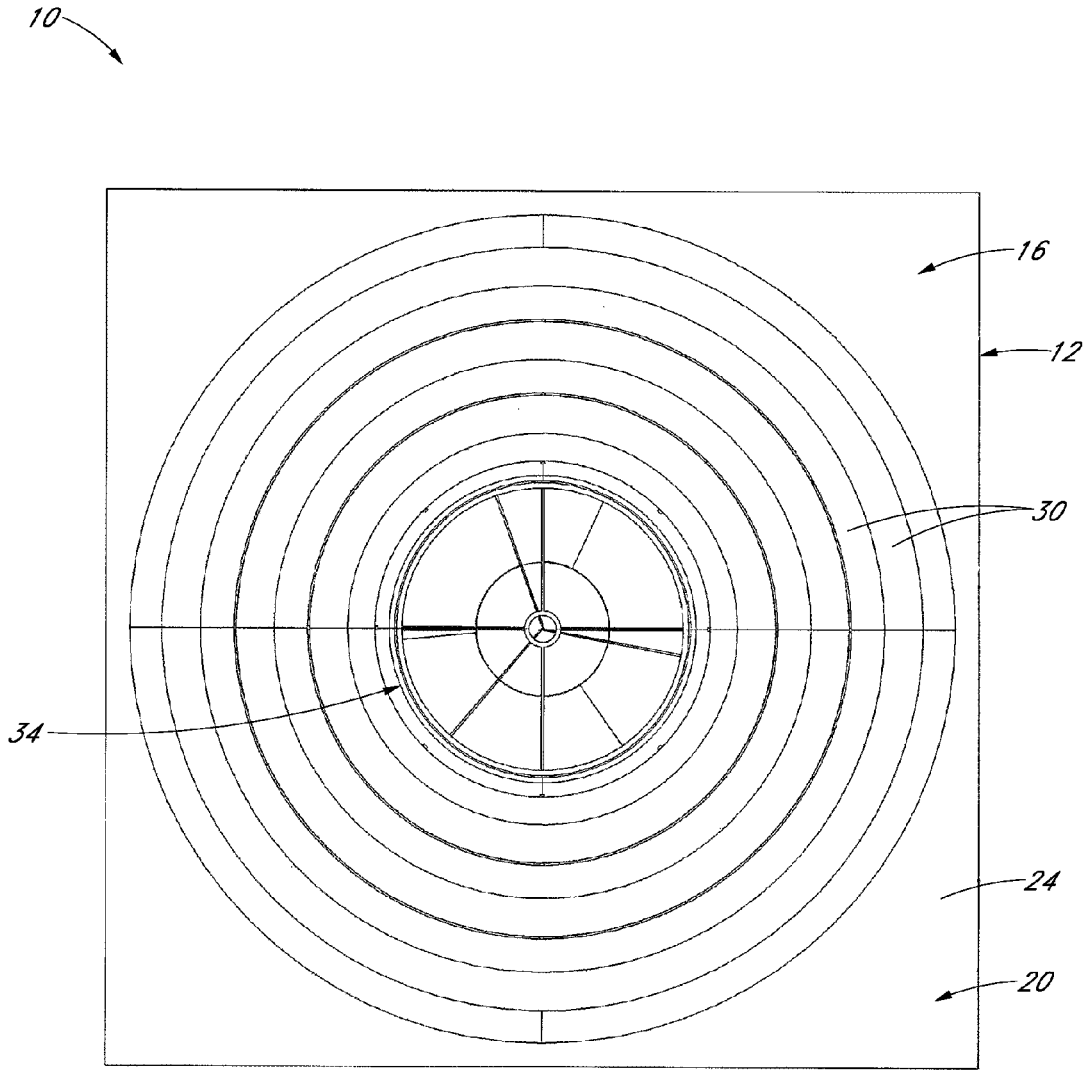
FIG. 5 is a bottom plan view of the device of FIG. 1.

With continued reference to FIGS. 3 and 9, in some embodiments the air moving device 10 can comprise a longitudinal axis L that runs through a middle of the air moving device 10. The housing member 12 can comprise an opening 46 for insertion of the nozzle 34, and the nozzle 34 can comprise at least one spherical surface 48 configured to fit within the opening 46 such that the nozzle 34 can be adjusted angularly relative to the longitudinal axis L. For example, the nozzle 34 can rest within the opening 46, such that the spherical surface 48 contacts the housing member 12, and is not rigidly attached to the housing member 12. In this manner, the housing member 12 can act as a gimbol, allowing pivoted rotational movement of the nozzle 34. The nozzle 34 can be moved at an angle or angles relative the longitudinal axis L, so as to direct the column of air leaving the air moving device 10 towards different directions. In some embodiments, the nozzle 34 can be vertical or angled at least 10 degrees relative to the longitudinal axis L in one or more directions. In some embodiments, the nozzle 34 can be angled at least 15 degrees relative to the longitudinal axis L in one or more directions. In some embodiments the nozzle 30 can be angled at least 20 degrees relative to the longitudinal axis L in one or more directions. In some embodiments, the nozzle 34 can be angled at least 45 degrees relative to the longitudinal axis L in one or more directions. In some embodiments the nozzle 34 can self-lock in place once it has been repositioned. For example, the weight of the nozzle 34, and/or the coefficients of friction of the materials used to create the nozzle 34 and housing member 12, can be such that the nozzle 34 can frictionally lock itself in place in various positions. In some embodiments, the nozzle 34 and/or housing member 12 can incorporate one or more mechanical or other types of mechanisms for locking the nozzle 34 in place once it has been repositioned.

While use of a spherical surface on the nozzle 30 is described and illustrated, other types of mechanisms could also be used to permit relative movement of the nozzle 30, and/or to allow the nozzle 30 to be locked in place in various angular positions.

In some buildings, there are support beams, ductwork, conduit, wiring, or other structures that would otherwise block the flow of a columnar air moving device, or make it difficult for an air moving device to direct air to a desired area. Therefore, at least one benefit achieved by having a nozzle 34 that can be repositioned is the fact that the air moving device 10 can be positioned in or below a ceiling, some distance away from an area in need of de-stratification, and the nozzle 34 can simply be adjusted so as to direct the column of air towards that area of need.

With continued reference to FIG. 9, the air moving device 10 can further comprise at least one anti-swirl member 50. The anti-swirl member 50 can be located within the interior space of the air moving device 10 formed by the housing member 12. In some embodiments, one or more anti-swirl members 50 can be attached to an interior surface of the upper housing section 14. The anti-swirl members 50 can be used to slow down and/or inhibit swirling of air within the interior space located above the rotary fan assembly 36. For example air can be swirling turbulently, at a top of the air moving device 10 after it has entered the device. The anti-swirl members 50 can extend into the space where the air is moving and slow the air down, and/or redirect the air, so that the air is directed more linearly down towards the nozzle 34. It can be desirable to slow down and/or inhibit swirling of air, such that the air can be directed more easily in a generally columnar pattern down through the nozzle 34 with greater ease and efficiency. The anti-swirl members 50 can be used to inhibit turbulence within the air moving device 10. In some embodiments, the anti-swirl members 50 can comprise one or more ribs. The ribs can extend along an inside surface of the housing member 12. The ribs can inhibit a swirling pattern of air.

In some embodiments, the air moving device 10 can be a self-contained unit, not connected to any ductwork, tubing, or other structure within a room or building. The air moving device 10 can be a stand-alone de-stratification device, configured to de-stratify air within a given space.

In some embodiments, the air moving device 10 can have an overall height (extending from the top of the housing member 12 to the bottom of the nozzle 34) that ranges from between approximately one foot to four feet, though other ranges are also possible. For example, in some embodiments the air moving device 10 can have an overall height that ranges from approximately one feet to three feet. In some embodiments the housing member 12 can have an overall outside diameter that ranges from approximately 8 inches to 30 inches, though other ranges are also possible. For example, in some embodiments the housing member 12 can have an overall outside diameter that ranges from approximately 12 inches to 24 inches. In some embodiments, the nozzle 30 can have an outside diameter that ranges between approximately five inches to twelve inches, though other ranges are possible. For example, in some embodiments the nozzle 30 can have an outside diameter that ranges from between approximately eight to ten inches. In some embodiments the air moving device 10 can have a motor with an overall power that ranges between approximately 720 and 760 watts, though other ranges are possible. In some embodiments the air moving device 10 can have a motor with an overall power that can vary from approximately 10 to 740 watts.

Figure 11:
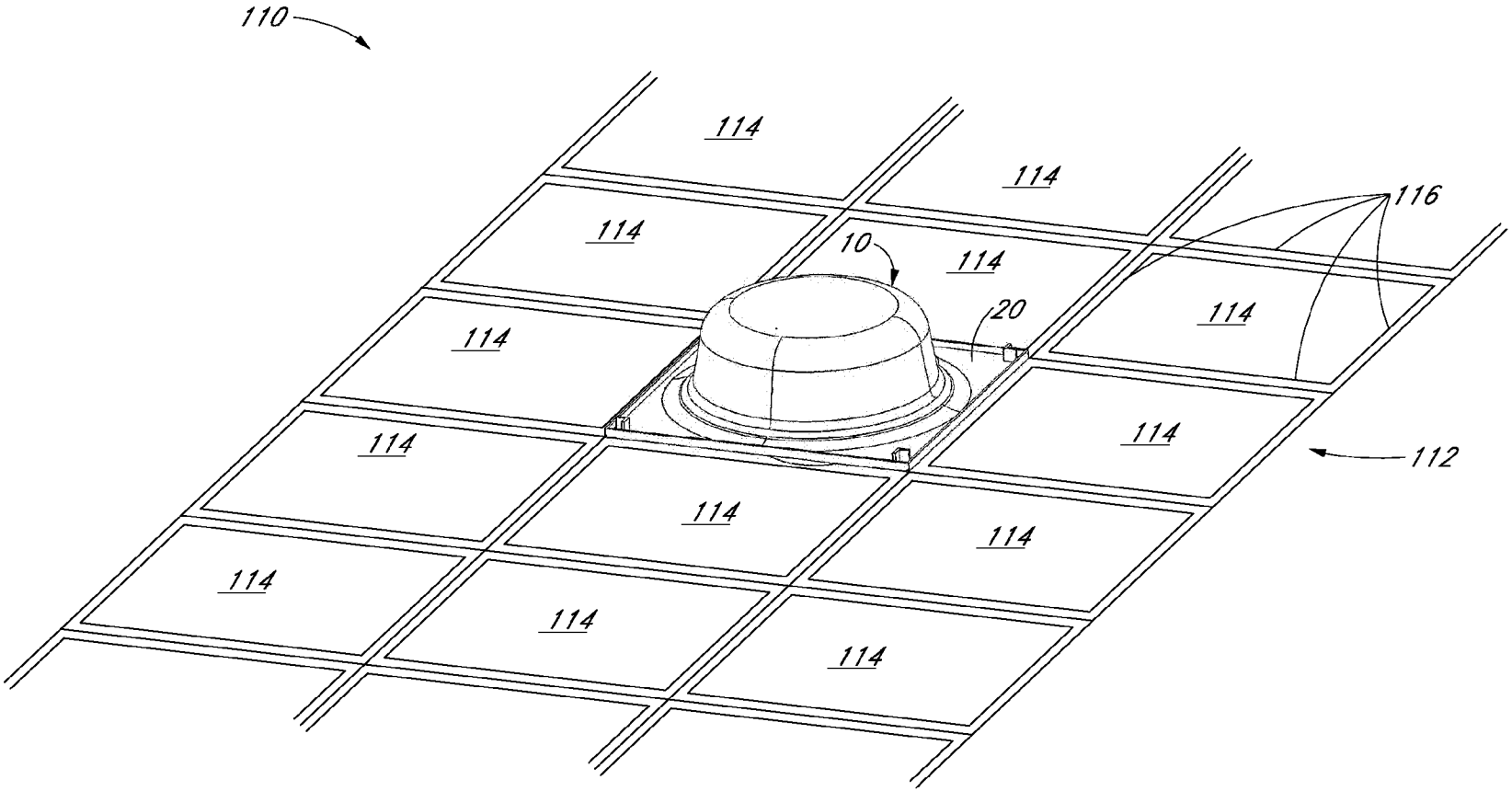
FIG. 11 is a schematic, perspective view of an air moving system in accordance with an embodiment.
Figure 12:
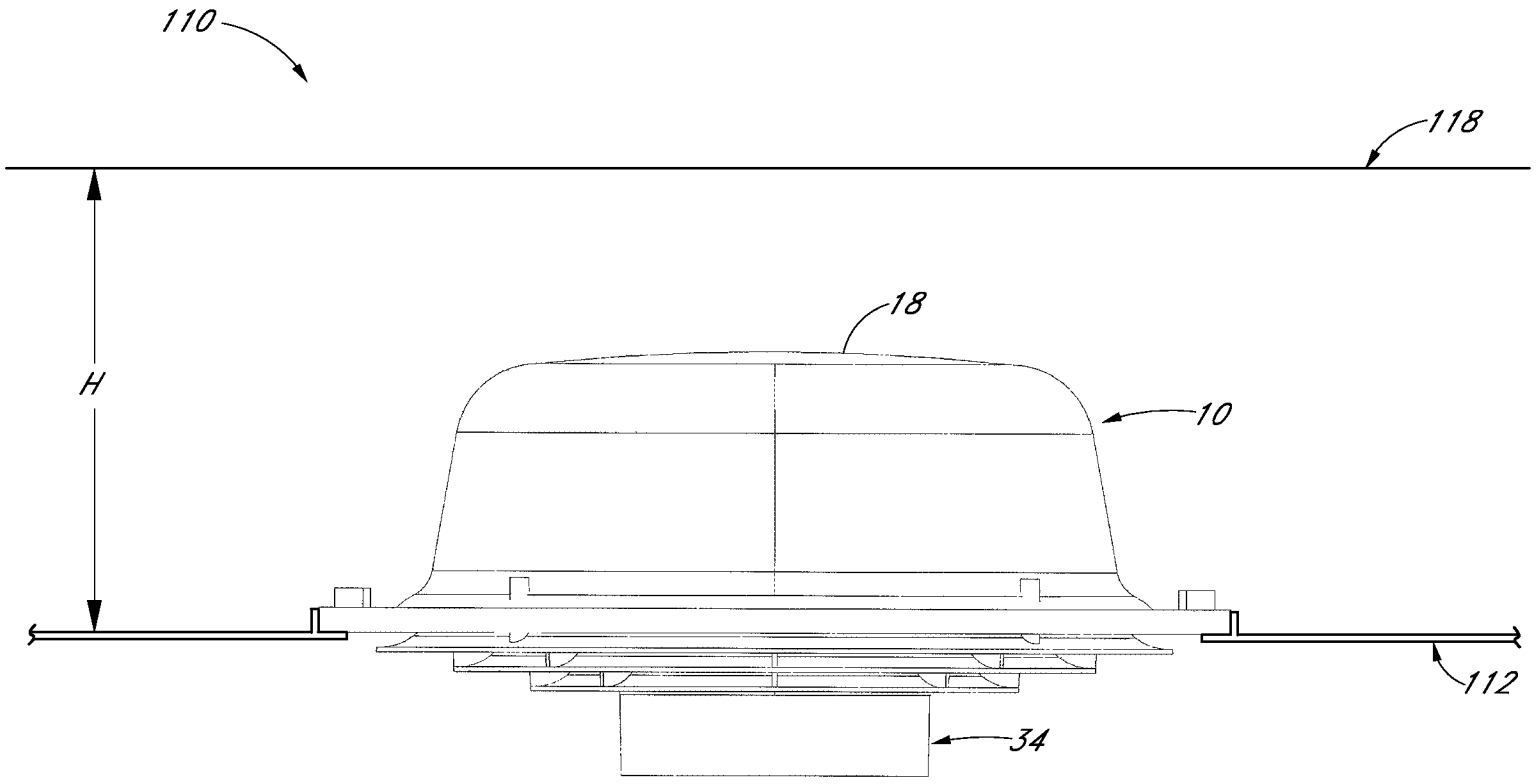
FIG. 12 is a schematic, front elevational view of the air moving system of FIG. 11.

With reference to FIGS. 11 and 12, an air moving system 110 can comprise a first ceiling level 112 forming a base portion of a ceiling in a building or room. The first ceiling level 112 can comprise a plurality of grid cells 114. Each of the grid cells 114 can be bordered by at least one grid cell periphery structure 116. In some embodiments, at least a portion of the grid cell periphery structure 116 can have a t-shaped cross section. In some embodiments, the grid cells 114 can comprise an open space between the grid cell periphery structures 116. The grid cells 114 can be generally rectangular. In some embodiments the grid cells 114 are approximately 24 inches by 24 inches in size, though other sizes and shapes are also possible.

In some embodiments, the ceiling support structure 20 can be configured to rest on or be attached to one or more grid cell periphery structures 116. For example, in some embodiments the air moving device 10 can rest on two grid cell periphery structures 116. In some embodiments the air moving device can rest on four grid cell periphery structures 116. In some embodiments, the grid cell periphery structures 16 can be configured to support the ceiling support structure 20 and air moving device 10. In some embodiments, the grid cell periphery structures 16 are attached to the ceiling support structure 20, for example with at least one fastener. In some embodiments the grid cells 114 can have generally the same outer peripheral profile as the ceiling support structure 20, such that the ceiling support structure 20 is configured to rest on the surrounding grid cell periphery structures 116, and the air moving device 10 fits easily within a single grid cell 114. As described above, seismic connect tabs 26 can be used to provide further connection.

With reference to FIG. 12, the air moving system 110 can further comprise a second ceiling level 118. The second ceiling level 118 can be separated from the first ceiling level 112 by a height H. In some embodiments, both the first and second ceiling levels 112, 118 are generally horizontal structures. In some embodiments the first and second ceiling levels 112, 118 are parallel to one another. As described above, and as illustrated in FIG. 12, an air moving device 10 can be configured to fit within the air moving system 10 such that the top surface 18 is located between the first and second ceiling levels 112, 118. The low vertical profile of the air moving device 10, and in particular the upper housing section 14, advantageously enables the air moving device to fit within this space between the first and second ceiling levels 112, 118.

Overall, the air moving system 110 can permit multiple air moving devices 10 to be supported by or attached to the grid cell periphery structures 116. The air moving devices 10 can be removed, replaced, or moved in the air moving system 110. If required, and as described above, the nozzles 34 can be moved, pivoted, and/or rotated, depending on where it is desired to direct air within a building or room having an air moving system 110.

In some embodiments, the air moving device system 110 can comprise a solid ceiling structure (e.g. a drywall structure). A portion of the ceiling structure can be removed to make room for the air moving device 10. For example, a portion of drywall or other material can be cut out, and the air moving device 10 can be supported by and/or mounted to the ceiling structure in the air moving device system 110, with at least a portion of the air moving device 10 located within the cut-out portion.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An air moving system comprising:

a ceiling structure comprising a first ceiling level forming a base portion of the ceiling, the first ceiling level having a plurality of grid cells, each grid cell bordered by a grid cell periphery structure, the ceiling structure further comprising a second ceiling level separated from the first ceiling level by a first height;

an air moving device positioned at least partially within one of the grid cells in the first ceiling level, the air moving device comprising:

a housing member forming an interior space within the air moving device, the housing member having a top surface, the housing member being positioned within the ceiling structure such that the top surface is located between the first and second ceiling levels;

a ceiling support structure forming an outer peripheral edge of the air moving device and attached to the housing member, said ceiling support structure defining an exposed lower surface, the ceiling support structure supported by the grid cell periphery structure;

the housing member comprising a plurality of air vents for directing a volume of air into the interior space of the air moving device, the air vents having an upstream end and a downstream end, a rotary fan assembly mounted in the interior space and supported by the ceiling support structure, the rotary fan assembly comprising an impeller and a plurality of blades, the rotary fan assembly configured to direct the volume of air within the interior space, the rotary fan assembly having an upstream end and a downstream end; and a nozzle communicating with and extending downwardly from the rotary fan assembly, the nozzle comprising a structure for further directing the volume of air out of the air moving device, the nozzle defining a spherical surface which cooperates with a surface of the housing member to enable the nozzle to pivotably rotatably move with respect to a longitudinal axis of the air moving device;

wherein the downstream end of the air vents is positioned adjacent the downstream end of the rotary fan assembly; and wherein the housing member comprises a plurality of ring-shaped structures of varying diameter connected to one another, wherein gaps exist between each of the plurality of ring-shaped structures, the gaps forming the plurality of air vents and wherein the surface of the housing corresponds to a widest portion of an interior of the nozzle as measured perpendicular to a longitudinal axis of the nozzle.

2. The air moving system of claim 1, wherein the ceiling support structure rests on the grid cell periphery structure.

3. The air moving system of claim 1, wherein the ceiling support structure is secured to the grid cell periphery structure by at least one fastener.

4. The air moving system of claim 1, wherein the housing member comprises an upper housing member and a lower housing member, the upper housing member connected to the lower housing member.

5. The air moving system of claim 4, wherein the rotary fan is mounted to the lower housing member.

6. The air moving system of claim 1, wherein the nozzle comprises at least one stator vane.

7. The air moving system of claim 1, wherein the housing member comprises at least one anti-swirl member.

8. The air moving system of claim 1, wherein the housing member comprises at least one seismic connect tab.

9. An air moving device comprising:

a housing member forming an interior space within the air moving device, the housing member comprising a plurality of air vents for directing a volume of air into the interior space of the air moving device;

a ceiling support structure forming an outer peripheral edge of the air moving device and attached to the housing member, the ceiling support structure configured to be supported by a grid cell periphery structure, wherein the ceiling support structure has an exposed lower surface;

a rotary fan assembly mounted in the interior space, the rotary fan assembly comprising an impeller and a plurality of blades, the rotary fan assembly configured to direct the volume of air within the interior space; and a nozzle communicating with and extending downwardly from the rotary fan assembly, the nozzle defining a longitudinal axis and comprising a structure for further directing the volume of air out of the air moving device;

wherein the air moving device comprises a longitudinal axis, the housing member comprises an opening for insertion of the nozzle which defines a support surface, and the nozzle comprises at least one spherical surface configured to fit within the opening and move with respect to the support surface such that the nozzle can be adjusted at various angles relative to the longitudinal axis of the air moving device; and wherein the at least one spherical surface corresponds to a widest portion of an interior of the nozzle as measured perpendicular to the longitudinal axis of the nozzle and further comprising at least one ionization cell and at least one cutout configured to create a space for the ionization cell.

10. The air moving device of claim 9, wherein the nozzle is configured to be adjustable from 0 to 45 degrees relative to the longitudinal axis in at least one direction.

11. The air moving device of claim 9, wherein the nozzle is configured to be locked in a plurality of different angular positions.

12. The air moving device of claim 11 wherein the nozzle is self-locking.

13. The air moving device of claim 9, wherein the housing member comprises a plurality of ring-shaped structures of varying diameter connected to one another, wherein gaps exist between each of the ring-shaped structures, the gaps forming the plurality of air vents.

14. The air moving device of claim 9, wherein the housing member comprises an upper housing member and a lower housing member, the upper housing member connected to the lower housing member.

15. The air moving device m of claim 9, wherein the nozzle comprises at least one stator vane.

16. The air moving device of claim 9, wherein the housing member comprises at least one anti-swirl member.

17. The air moving device of claim 9, wherein the housing member comprises at least one seismic connect tab.

18. The air moving device of claim 14, wherein the rotary fan is mounted to the lower housing member.

* * * * *